United States Patent [19]

De Feo

[11] 4,216,453

[45] Aug. 5, 1980

[54] LAMINATED SPRING FOR RELAYS AND THREE-WAY SWITCHES

[75] Inventor: Carlo De Feo, Arzano, Italy

[73] Assignee: Industria Politecnica Meridionale S.p.A., Arzano, Italy

[21] Appl. No.: 852,377

[22] Filed: Nov. 17, 1977

[30] Foreign Application Priority Data

Dec. 22, 1976 [IT] Italy ..... 52742 A/76

[51] Int. Cl.[2] ..... H01H 63/02

[52] U.S. Cl. ..... 335/133; 335/196

[58] Field of Search ..... 335/133, 134, 135, 196, 335/128, 199

[56] References Cited

U.S. PATENT DOCUMENTS 3,501,720 3/1970 Mathys ..... 335/135

4,008,447 2/1977 Anderson et al. ..... 335/128

FOREIGN PATENT DOCUMENTS 462973 11/1968 Switzerland ..... 335/196

1123100 8/1968 United Kingdom ..... 335/135

*Primary Examiner*—George Harris

*Attorney, Agent, or Firm*—Townsend and Townsend

[57] ABSTRACT

Laminated springs for obtaining relay three-way switch and the like, made of an elastically deformable conductive metal, each having two fore elongated sustantially parallel arms extending along about the half of the spring length, near the free ends of which are fixed, contact pads having a substantially semi-cylindrical shape and applied thereon with their longitudinal flat surface so that the generatrices of each co-operating pairs of pads are set at right angles to one another, while at the back portion each laminated spring comprises a longitudinal tongue extending backwardly, having a predetermined length and bent at right angle in regard to the laminated spring plane, between the pair of fore arms and the rear tongue of each spring a through hole being bored. The invention also concerns the assembly method of said laminated springs and the relays obtained therewith.

5 Claims, 5 Drawing Figures

LAMINATED SPRING FOR RELAYS AND THREE-WAY SWITCHES

The present invention concerns contact laminated springs designed to form a pack of at least three pluralities of superposed laminated springs constituting the exchange members of a relay, three-way switch or the like. Said sets of laminated springs are suited to be assembled in groups, each set comprising three or more laminated springs which are juxtaposed to each other. The already known contact laminated springs which are assembled by groups so as form the exchange members of a relay, three-way switch or the like offer several disadvantages.

First of all the springs of each set are subjected to the so called "return-shock effect" towards their rest position; i.e. they perform a damped oscillating movement towards their starting or off-position, when the straining action of the contact member or control load ends. Said oscillations cause a unreliable contact between the facing contact elements. This problem is further negatively affected by the conventional shape and disposition of the contact points or pads which are fixed on the respective laminated springs in an accordingly aligned manner so that, as a result of the unavoidable tolerances of these devices; that is the merely point-like contact could be missing, which can, on the contrary, be ensured only in the case of a very correct alignment of the co-operating contacts.

In order to overcome such an inconvenience, fork-ended laminated springs have been disclosed, which present a bifurcation near that end thereof, which is designed to establish the contact; said bifurcation is, however, limited merely to that short end portion of the contact member, which can perform a free deflection. To each arm of said fork-like end of each contact member a semispherical contact element or pad is fixed so that each contact member comprises two contact elements or points in order to give a further possibility to obtain the contact.

For their control these known laminated springs require a force of a remarkable value in order to be deformed and, as a result thereof, a higher current must be required for energizing the electromagnetic circuit in order to overcome the weight and rigidity of said known contact members.

In the fact a contact laminated spring can be considered similar to a cantilever beam, fixed at one end and which is subjected to the load of the control force at its outer free end. The bending effect, acting on such a spring, is a function of its length, of the coefficient of elasticity of the material of which the spring is made, of the load acting on the spring and of the moment of inertia. It is also necessary to point out, that, when the control force ends, the spring elastically returns to its starting position, performing a series of damped oscillations. Owing to the fact that the amplitude and duration of said oscillations are a direct function of the spring mass, it results that the amplitude and number of said oscillations can be reduced only by reducing the movable mass to the minimum. That cannot occur in the case of the already known aforementioned laminated springs, since their bifurcation, which is provided only near their end, cannot produce any shape slenderness or any appreciable weight reduction. The present invention overcomes said inconveniences and disadvantages of the laminated contact springs of the prior art, providing contact laminated springs carrying two contact elements or pads of a semicylindrical shape, and mounting the facing co-operating pads in a mutual crossed relationship so as to ensure a more reliable contact and the minimum of damped oscillations. This task is attained by the present invention by constructing particularly shaped laminated springs adapted to be easily and correctly assembled to form a pack of sets of contact laminated springs. The pack includes three or more superposed contact spring sets, assembled in vertically correctly aligned relationship, each of said contact springs comprising two longitudinal substantially parallel fore arms extending along at least the half of the length of the spring and having outer longitudinal side tapered outlines; i.e. said outer sides are so shaped to include a first tapered side outline at that portion thereof which is near the junction zone of the arms, and a second portion parallel to the longitudinal centre line of the spring and on which arms the contact elements or pads are fixed. The springs of each plurality has also a longitudinal rear tongue, extending towards its opposite end. The three or more pluralities of springs have tongues of different lengths. Said tongues will be then bent at right angle with regard to the remaining portion of each spring, when the spring pluralities are assembled in superposed relationship and are so long, that, as their assembly has been performed, all the ends of said tongues are placed in a same horizontal plane, which is parallel to those of the pluralities of springs as these latter are in said assembled condition. The cross sections of said springs has been so calculated so as to be as small as possible, but sufficient to resist the load acting thereon, and therefore such as to offer the smallest strength to the deformation as well as to require the minimum of current for energizing the control electromagnet provided to actuate the movable contact spring set or sets. In the fact the areas of the various cross sections of the springs have been calculated in such a manner that the stress acting thereof be equal to that which can be born by the springs and lower than the elasticity limit of the material. In order to promote the return of each movable contact spring towards its rest or off position, a small initial return load can be imparted to said movable springs. Further, the particular shape of the laminated springs, according to the present invention, provides the ability to automatize their assembly method, with a consequent saving of machining, assembly time and production costs. In fact, the invention also concerns a method for constructing and assembling said laminated springs, starting from continuous strips of sheet material of the type used for the construction of the conventional contact springs. By the use of a slotting machine or the like of a gradual operative type from each metal strip all the portions are removed which exceed the desired pattern of each spring and for separating the springs from each other by means of transverse shaped slots; therefore into each continuous metal band a series of springs will be obtained, which are placed side by side to each other, said shaping also including the creation of solid longitudinal edge bands which maintain the series of springs in a correct mutual relationship so as to assist their easy assembly, as will be better explained therebelow. In the fact said continuous solid longitudinal edge bands will be removed only when their assembly operation, has been completed.

After the slotting step, each shaped strip can be wound up on a reel; subsequently the contact pads are welded near the ends of the spring arms, said contact pads consisting of semi-cylindrical conductive elements which will be so positioned and fixed that the contact pads of one of the contact spring strip are set at right angles with regard to those applied on the facing end surfaces of the set or sets of springs of the adjacent co-operating spring strip or strips so that each co-operating pair of contact pads is positioned in a mutual crossed relationship which ensures a more reliable contact between the so shaped semicylindrical pads of each contact pair than the conventional semispherical or point contact pads, since, according to this invention, the contact takes place between two contact generatrices set a right angle of the two facing semicylindrical contact pads. In this manner a clean and sure contact is obtained, owing to the mutual wiping effect of the spring contacts, caused by the movement transmitted by the control actuating device. In addition, as has already been stated, there is also a double contact between each pair of co-operating springs, since each contact spring has two contact arms, each carrying one contact pad and which is applied near the end portion of each arm of the respective spring.

Then, according to the desired number of the exchange contacts, from each metal strip will be cut lengths including the desired number of springs; subsequently said lengths will be superposed to each other with the interposition of short insulating plates, associated with guiding means so as to form a pack of three or more sets of contact springs, said pack being then mounted on the support base of a relay.

As will be apparent from what has been aforementioned, the main characteristic of said arrangements consists in the fact that the assembly does not require any skilfulness or adjustment in order to obtain the correct load pressure and the correct mutual alignment of the contact springs at their contact points. In the fact the spring sets are assembled and connected to the relay body, while maintaining the continuous solid longitudinal edge bands of the metal strips, thus ensuring the correct mutual relationship of the springs of the co-operating spring sets. In addition each spring set is maintained in a correct relationship with the spring sets positioned over and/or below thereof by means of vertical small columns and by partition walls, these latter also serving for insulating a contact spring from the adjacent ones so that also in the event that one contact spring breaks, it is maintained at its place owing to the presence of said side insulating partition walls.

This particular shape and disposition of the contact springs allows to assemble spring sets, according to the method of this invention, also in the case in which there is very limited available space provided to receive the contact spring pack, as, for instance, when associated miniaturized printed circuits are used, which are wired on cards and spaced apart from each other of little distances, also enabling to weld easily the end feet of the spring tongues to said circuits or to other circuitry components by the use of automatized devices, as, for instance, with the so called "tin alloy wave system".

The contact laminated springs according to the present invention and the method for their assembling will be now described in more detail in a preferred embodiment, taking in consideration the accompanying drawings, in which.

Figure 3:
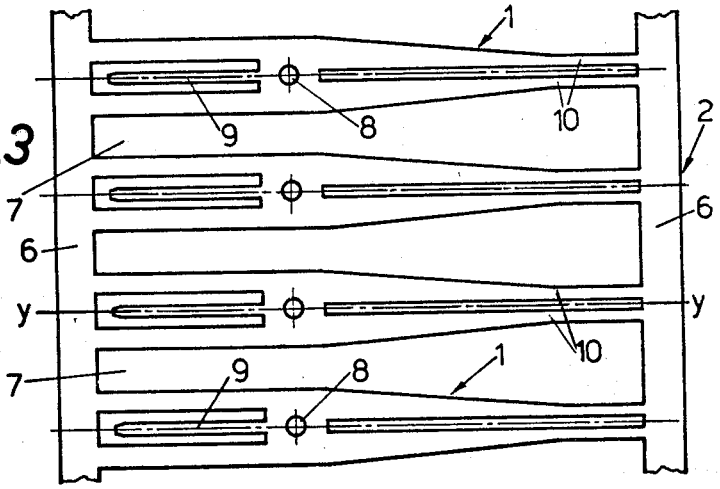
FIG. 3 is a top view of a portion of a metal strip, in which a plurality of laminated springs are obtained.

In the drawings a relay is shown which includes three sets of four contact laminated springs, generally marked 1, the thickness of the parts being increased for clarity (FIG. 3). Between the two outer sets of stationary springs 1*a* and 1*c* there is a set of four movable contact springs 1*b*, which are actuated at the same time by an actuating member, generally indicated 3, controlled by the movable armature 4 of an electromagnet housed in the casing 15 of said relay, as will be better hereinafter described. When the electromagnet is de-energized the movable armature 4 allows the electrical contact between the contact springs 1*a* and 1*b* to be re-set under the effect of a return spring 5 which returns the armature 4 in its raised rest position, as well as a predetermined inner load of the springs 1*b*.

Each set of the laminated springs 1 (FIG. 3) is obtained starting from a continuous strip generally marked 2, made of an elastically deformable metal and which is subjected to a slotting operation so as to define in each strip 2 a plurality of transversally oriented laminated springs 1 of the same size and shape, the spring member 1 being connected to each other by longitudinal solid side bands 6, which will be subsequently cut away; the informing principle, on which is based the shaping of the pluralities of superposed sets of springs 1*a*, 1*b* and 1*c* is the same, but the lengths of the different sets of springs 1, i.e. the width of each strip 2 and some other characteristics thereof are different. As has been hereabove stated the springs 1 of each plurality remain connected to each other by means of the longitudinal edge bands 6 until their assembly has been completed and each spring 1 is spaced apart from the adjacent ones by means of a shaped transverse slot 7 (FIG. 3). Through the spring thickness at an intermediated point thereof a hole 8 is bored. On the back portion of each spring 1 a longitudinal central tongue 9 is obtained, the free end of which extends backwardly in regard to the respective spring 1, which at its front portion forms two longitudinal arms 10; the spring arms 10 are so shaped as to have a first portion, near to the hole 8, having an outer tapered side and a following portion having a substantially rectilinear outer side, parallel to the longitudinal centre axis Y—Y of each spring 1 (FIG. 3).

Figure 1:
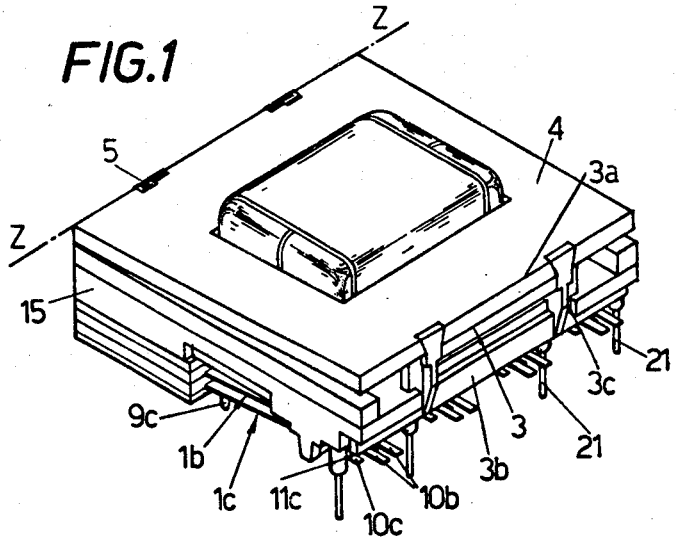
FIG. 1 is a perspective view of a relay provided with a pack of contact springs according to the invention.
Figure 2:
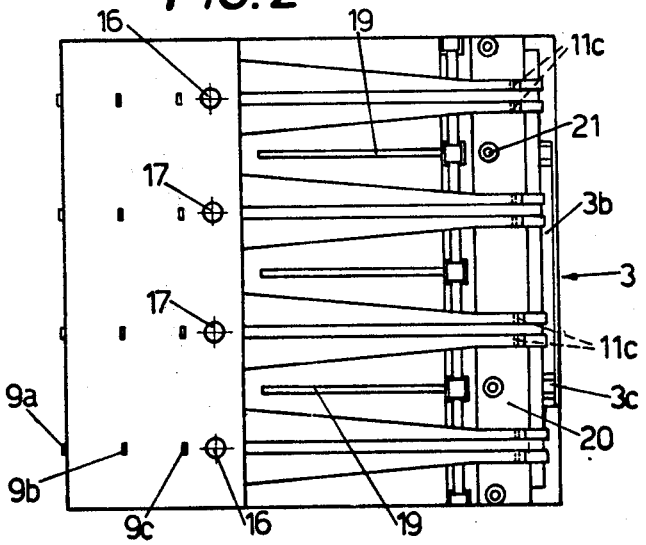
FIG. 2 is a view from below of the relay body of FIG. 1.
Figure 4:
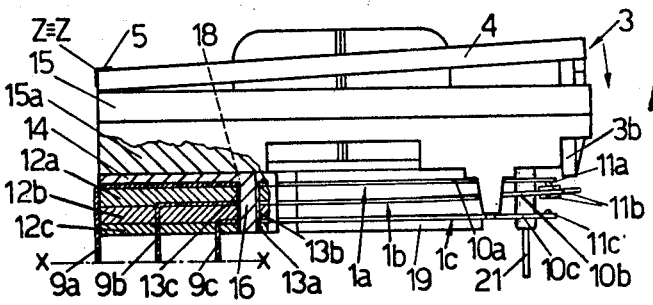
FIG. 4 is a side view partly in section of the relay body of FIG. 1.
Figure 5:
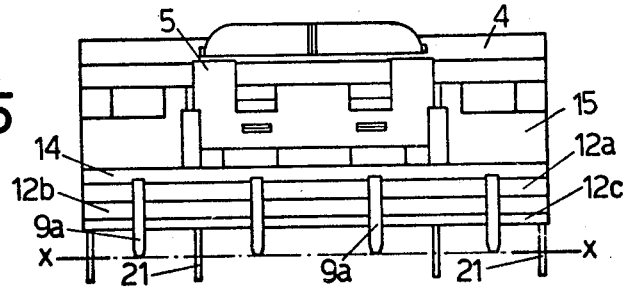
FIG. 5 shows the back view of the relay of FIG. 1.

In the shown embodiment a strip 2 is designed to form the first upper set of springs 1*a* which have the tongues 9*a* longer than those of the tongues 9*b* of the springs 1*b* and which in turn, are longer than those of the set of springs 1*c*. The springs 1*a* and 1*c* are designed to form the upper and lower sets of stationary springs 1*a* and 1*c*, and have the arms 10*a* and 10*c* of the same length, while the arms 10*b* of the movable intermediated springs 1*b* are longer than the arms 10*a* and 10*c*, since they must extend frontwardly beyond the ends of the arms 10*a* and 10*c* so as to be able to be actuated by the control framing 3, controlled, in turn, by the movement of the armature 4. Near the free ends of the arms 10*a*, 10*b*, 10*c*, are fixed the contact pads generally marked 11 (11*a*—11*a*, 11*b*—11*b*, 11*c*—11*c* in FIG. 4), which are so spaced apart from the respective ends of the arms 10*a*, 10*b*, 10*c* so that, as the sets of springs 1*a*, 1*b* and 1*c* are mounted, they are positioned in superposed vertical alignment. The contact pads 11*a*, 11*b*, 11*c* are shaped as semi-cylindrical bodies, as FIG. 4 illustrates, the contact pads 11*a* and 11*c* are applied on the surfaces of the arms 10*a* and 10*c* facing the arms 10*b*, while contact pads 11*b* are applied on both surfaces of the arms 10*b* of the intermediated movable springs 1*b*. In addition, the semicylindrical pads 11*a* and 11*c* have their generatrices set at right angles in regard to those of the contact pads 11*b* (FIGS. 2 and 4). This arrangement of contact pads 11*a*, 11*b*, and 11*c* assists in obtaining a sure electrical contact therebetween and in maintaining the contact surfaces free of oxides, owing to the friction effect created between the co-operating contact elements of the contact springs as the relay becomes operative. The tongues 9*a*,9*b*,9*c* can be bent along their longitudinal centre line to increase their rigidity. Said tongues 9*a*,9*b* and 9*c* are then bent at right angle with respect to the spring planes and introduced into slots arranged through the insulating plates 12*b*, 12*c* of a group of three plates 12*a*,12*b*,12*c* provided to support and insulate the three spring sets 1*a*,1*b* and 1*c* at their rear part. Said plates 12*a*, 12*b* and 12*c* are also provided with through holes 13*a*, 13*b* and 13*c* (FIG. 4) which in assembly condition of the components of the relay are in register with the holes 8*a*,8*b* and 8*c* respectively of the spring sets 1*a*,1*b*,1*c*. An upper plate 14 (FIGS. 4 and 5) is made integral with the electromagnet casing 15. Depending from the upper plate 14 are two columns 16 (FIGS. 2 and 4), designed to enter the coaxial and identical holes 8*a*,13*a*, 8*b*,13*b*, 8*c*,13*c*, for instance, positioned near the sides of the casing 15 so as to maintain a correct predetermined relationship between the adjacent springs 1 of the so assembled spring pack at their back part. From the bottom wall 15*a* of the casing 15 also depend two other columns 17, designed to be received into the remaining coaxial two sets of holes 8*a*, 13*a*, 8*b*,13*b*, 8*c*,13*c* and through two respective holes 18 arranged through the plate 14. From the bottom wall 15*a* further depend partition walls 19 (FIG. 4), designed to be inserted through the slots 7 (FIG. 2) and having the same guiding purpose as the columns 16 and 17, but which are also designed to insulate a spring from the adjacent ones, so that even if a spring breaks, it can never come into contact with the adjacent ones. Insulating posts 20 depend from the casing bottom 15*a* and function to keep separate the fore parts of the arms 10*a*, 10*b*,10*c* as well as serve to guide the movable arms 10*b* during their movements. The lengths of the bent tongues 9*a*,9*b* and 9*c* are such that as the spring sets 1*a*,1*b* and 1*c* are mounted between the plates 14,12*a*,12*b* and 12*c*, their ends extend downwardly from the plate 12*c* and reach the same plane X—X, parallel to the planes of the spring sets 1*a*,1*b* and 1*c*, so as to act as terminals and to be brought into contact which the respective electric devices of the associated circuitry. Through the posts 20 pass the terminals 21 of the electromagnet circuits. After the pack of spring sets 1*a*, 1*b* and 1*c* have been assembled with an easy, quick and substantially automatic assembly operation, owing to the presence of the guiding means, i.e. the tongues 9*a*,9*b* and 9*c*, the columns 16, the outer bands edges 6 of strips 2 can be cut away, since they have now fulfilled their function of holding the contact springs 1 in the relative, spaced-apart relation illustrated in FIG. 3. The spring pack can then be used and mounted where desired as a compact unit and the electromagnet bottom 15*a*, mounted thereof allowing partitions 19 and the posts 17 and 20 to be received into the respective seats. The plate 14 will be now connected to the casing 15; in this condition the control framing 3 is placed over the ends of the movable arms 10*b*. In rest or off condition of the relay, the respective co-operating pads 11*a* and 11*b* contact each other. As the electromagnet is energized, the armature 4 pivots about a rear pivot axis Z—Z in the clockwise direction in FIG. 4 and it urges the framing 3 to move downwardly. Said framing 3 comprises upper and lower connecting bars 3*a* and 3*b* made integral with two shaped uprights 3*c*. As the armature 4 rotates downwardly about the pivot axis Z—Z, the bar 3*b* urges the ends of the arms 10*b* downwardly up to bring the lower pads 11*b* thereof in contact with the fixed pads 11*c*. The bar 3*a* is connected to the front edge of the armature body 4 by means of a lightly pivotable connection so as to be able to lightly rotate downwardly so as to maintain the framing 3 always in a substantially vertical position in order to act in better condition on the movable spring arms 10*b*. Thus an improved transfer relay is obtained, according to the present invention.

What we claim is:

1. A contact spring for use in a laminated array forming a transfer relay or the like, the contact spring comprising:

a unitary, elongate spring member fabricated from an elastically deformable conductive metal and having a body portion and a fore portion of approximately equal longitudinal dimension, the fore portion being configured to form a pair of substantially parallel, longitudinally extending arm members having outer side outlines defining a first arm portion that tapers from the body portion and towards the ends of said arms and a second substantially rectilinear portion extending from the tapered portion of said arms, said body portion including an elongate tongue element shaped and configured to form a first longitudinally extending portion and a second portion extending substantially perpendicular from the first portion; and a pair of contact pads having a substantially semicylindrical shape and a longitudinal flat surface affixed to the rectilinear portion proximate at least one main surface of each arm.

2. A plurality of metal strips adapted to be mounted in relative registered, laminated configuration in a relay unit of a predetermined width to form a relay switch comprising a number of sets of laminated contact elements, each metal strip comprising:

a plurality of juxtaposed contact springs forming said contact elements, each being separated from adjacent ones by transverse slots formed in said strip and connected to one another by longitudinal solid outer edge bands of said strip, said strips having a transverse dimension sufficiently greater than the predetermined width of said relay unit so that when said strip is mounted in said relay unit said edge bands can be cut away leaving the juxtaposed contact springs; and a plurality of tongue elements formed in each strip, there being a tongue element associated and integral with each contact spring, the tongue elements of any one metal strip being equal in length to the other tongue elements of said metal strip, the tongue elements of various metal strips being of different length.

3. A relay switch apparatus comprising:

a case member;

an electromagnet mounted in said case member and including an armature movable between a first position and a second position and means for biasing said armature to said first position;

energizing means coupled to the electromagnet for effecting movement of said armature from said first position to said second position;

a pack of contact spring sets, including at least two sets of elongate stationary contact springs and at least a set of elongate, movable contact springs interposed between the sets of stationary contact springs, said contact spring sets being superposed in vertical alignment and oriented in relative registered relation so that the free ends of the movable spring move from a first position proximate the free ends of corresponding ones of the stationary contact springs to a second position proximate the free ends of corresponding ones of the other of said stationary contact springs;

first semi-cylindrical contact pads mounted to confronting surfaces of the stationary contact springs and proximate the free ends thereof; second semi-cylindrical contact pads mounted to opposing surfaces of the movable contact springs and positioned to engage the corresponding first contact pads when said movable contact springs are in said first or second positions, the axes of said first contact pads being set at substantially right angles to those of said second contact pads;

a planar, insulating plate member affixed to said casing and including means to cooperatively receive, hold, and orient said pack of contact spring sets, in registered operative relation to said electromagnet, said insulating plate including non-conductive partition walls that extend from said insulating plate and between the free ends of said vertically aligned movable and stationary contact springs; and said movable contact springs being of a predetermined length sufficient to allow the free ends thereof to extend beyond the terminal portions of the free ends of said stationary contact springs of each vertical aligned set, said armature having attached thereto a frame member adapted to operatively engage said free ends of said movable contact springs to move said free ends from said first position to said second position when said armature is also so moved.

4. A relay according to claim 3, wherein each movable and stationary contact spring is of a generally elongate configuration having a captured end that includes a longitudinal tongue element formed therein, each of said tongues being shaped and configured to have a first portion extending from and lying in the plane of the corresponding contact spring and a second portion extending generally perpendicular from said first portion and parallel to the second tongue portions of the other of the contact springs, said second tongue portions terminating in edges that are coplanar with one another, located outside the contact spring pack, and adapted to be received by and electrically connected to a printed circuit.

5. A relay according to claim 3, including means for pivotally attaching the frame member to the armature and for maintaining the frame member substantially perpendicular to the free ends of said movable contact springs during operative engagement therebetween.

* * * * *